US005875893A

United States Patent [19]

Lee et al.

[11] Patent Number: 5,875,893

[45] Date of Patent: Mar. 2, 1999

[54] PRODUCT DISPLAY PACKAGE

[75] Inventors: Noel Lee, South San Francisco; Peter A. Radsliff, San Mateo, both of Calif.

[73] Assignee: Monster Cable International, Ltd., South San Francisco, Calif.

[21] Appl. No.: 581,117

[22] Filed: Dec. 29, 1995

[51] Int. Cl.[6] ..... B65D 73/00

[52] U.S. Cl. ..... 206/463; 206/388; 206/463; 206/471

[58] Field of Search ..... 206/461–463, 206/471, 303, 388, 468

[56] References Cited

U.S. PATENT DOCUMENTS

| | | | |
|---|---|---|---|
| 3,402,810 | 9/1968 | Percelay | 206/461 |
| 3,414,159 | 12/1968 | Murr | 206/468 X |
| 3,881,257 | 5/1975 | Chasen | 206/461 X |
| 3,939,979 | 2/1976 | Neumayer | 206/461 |
| 4,535,890 | 8/1985 | Artusi | 206/468 X |
| 4,804,091 | 2/1989 | Segal | 206/463 X |
| 5,568,865 | 10/1996 | Mase et al. | 206/388 X |

FOREIGN PATENT DOCUMENTS

| | | | |
|---|---|---|---|
| 672303 | 3/1996 | Belgium | 206/463 |
| 2617140 | 12/1988 | France | 206/303 |

*Primary Examiner*—Bryon P. Gehman
*Attorney, Agent, or Firm*—Ostrolenk, Faber, Gerb & Soffen, L.L.P.

[57] ABSTRACT

A transparent plastic package for containing and displaying a product for sale, the package having front and rear panels releasably joined, the front panel having a forwardly extending projection with a spherical dome forming a cavity for receiving and displaying the product.

20 Claims, 3 Drawing Sheets

PRODUCT DISPLAY PACKAGE

FIELD OF THE INVENTION

This invention is in the field of display packages for products to provide both visibility of the product and accessibility of the product for manual inspection.

BACKGROUND OF THE INVENTION

In addition to fine quality and reputation of products that contribute to sales increases, other factors are obviously the appearance of the products and the sales presentation to customers, namely the packaging and advertising. This invention concerns the packaging for certain products where presentation to the customers is deemed to be a very important sales factor.

The products being packaged and displayed in the field of the present invention are audio speaker cables, interconnect cables for interconnecting audio, video and home entertainment systems including interconnects between TVs, VCRs, laser disc players, antennae, tape decks, amplifiers, etc. With high fidelity cables are similarly high quality connectors, often gold-plated. Finally, many of applicant's cables have unusually large diameter core wires and unusually large diameter transparent insulating jackets.

Another packaging objective is to provide high visibility of these cables and connectors in transparent packages with cables arranged in a compact yet highly attractive and high-tech style.

These objectives have been partially achieved with applicant's prior packaging as generally represented in applicant's U.S. Pat. Nos. D306,561, D328,248, D351,342 and 4,742,912.

In all these package designs a frontward directed generally circular shell or pancake-like projection is formed as a cavity or recess extending forward of the front part of the package. These shells are usually tapered to a smaller diameter at the most forward part, namely the bottom of the shell, which is then flat. The taper is used because it facilitates release of the shell from the mold, and the flat bottom is present because it is natural to terminate a cylinder with a flat end, it is the least expensive way for manufacture, and because alternative shapes were not contemplated.

Over a period of time and actual sales experience three problems have been discovered with these otherwise popular and successful package designs.

First, the flat front surface often reflects interior store lights in a way that either creates a glare, obstacle or distortion to good visibility and greatly detracts from the objective of an attractive and comfortably viewable display.

Second, the products put into these packages have become so numerous in models, styles and cable lengths that it is too expensive to create new packages for each variation.

Third, these are high quality, "high end" products usually costing more than traditional and generic speaker and connector cables. Traditionally, these products are in sealed display packages, being sealed by techniques such as riveting or heat sealing; however, customers of these premium products not only want to see them very clearly, they often want to "touch" them before deciding to purchase. Applicant wanted a display package that was more attractive than prior designs and was sealable, unsealable for intimate examination and resealable, while not losing its attractiveness.

SUMMARY OF THE INVENTION

The above-described problems with prior art display packages have been overcome with the new package design, having four totally new, attractive and highly functional structural features.

First, the front surface of the package is now a convex curved dome extending frontwardly toward the customer. This substantially eliminates glare, regardless of the direction of the store's interior light sources and allows overhead store lighting to better reach the product, and also provides an exciting new-style appearance.

Second, within the dome is an insert of the same dome shape for holding and positioning each model of cable and its connectors. Using different inexpensive inserts for different products which are all contained in the same basic outer package, a great variety of different packages are produced at an affordable cost. Many inserts have display fingers for holding and displaying the connectors in a spaced-apart and highly attractive manner.

Third, all the above has been provided in a new package comprising front and rear parts and insert, where the package is sealed, but is easily openable for manual inspection of the product, and reclosable without damaging the package or its appearance.

Fourth, an area of the dome portion of the insert is adapted for label placement which consequently positions or sandwiches the label on the inner dome and below and spaced from the outer dome, thus providing a "label under glass" appearance that is unique and appealing.

These and other features will be described below with respect to the preferred embodiments illustrated and described herein.

BRIEF DESCRIPTION OF THE DRAWING

In FIGS. 1–5 an audio cable is included to illustrate how such product is positioned and displayed in the new package.

DETAIL DESCRIPTION OF THE PREFERRED EMBODIMENT

Figure 2:
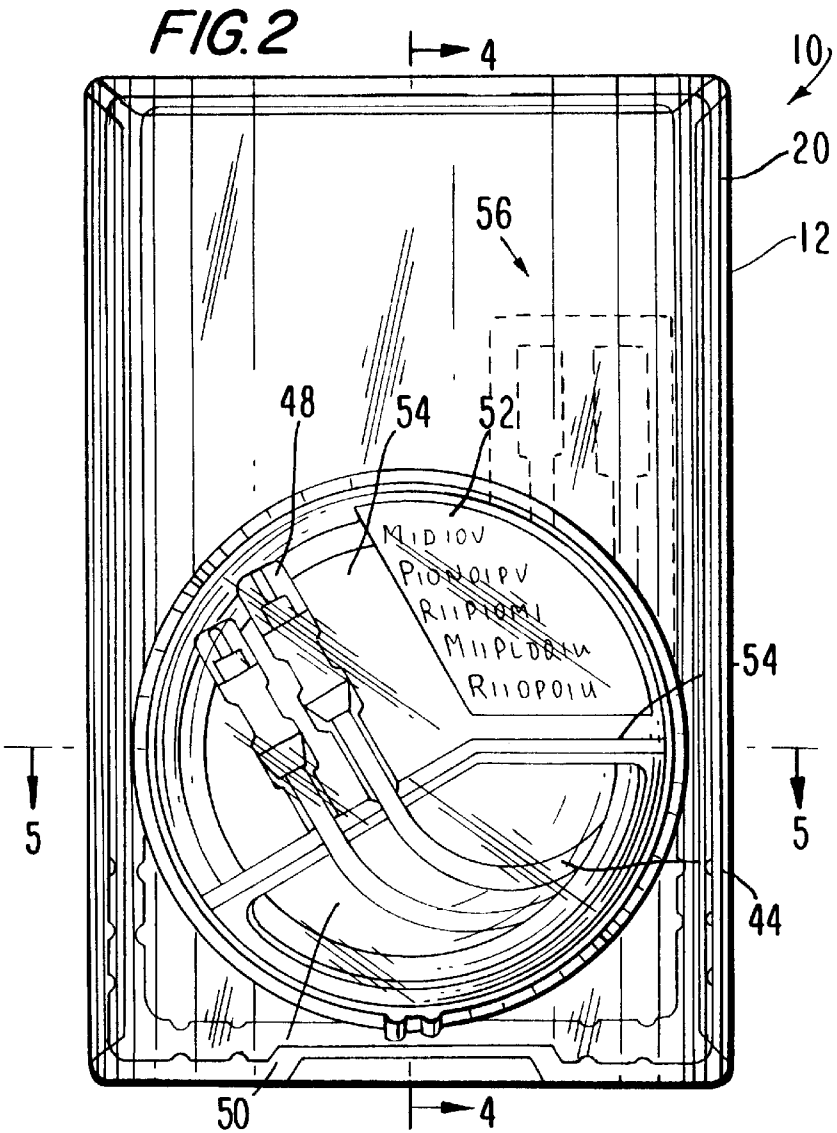
FIG. 2 is a flat elevation view thereof.

The new package 10 is constructed of three basic transparent plastic components, namely front part or panel 12, rear part or panel 14 and insert 16. The front and rear panels 12, 14 are releasably coupled together primarily by parallel edges or flanges 18 of rear panel 14 which slide in corresponding tracks 20 of front panel 12. Tracks 20 are formed by folding the side edges of first panel 12 into a 180° bend or U-shape with sufficient clearance 22 between the two sides of the track to slidably receive flange 18 extending lengthwise on rear panel 14.

Front panel 12 has an additional top track 24 to receive and stop top flange 26 of the rear panel when the latter is fully inserted along the side tracks 20-. At the bottom edge 28 of front panel 12 there is a flexible and resilient tab 30 folded into a U-shape. Upon said full insertion of the rear panel by sliding flanges 18 along tracks 20, the tab 28 is flexed forward in the direction of arrow 29 to allow corresponding bottom edge 32 of rear panel 14 to pass by. Then tab 28 is released to spring back to its position seen in section in FIG. 4 where it maintains the rear panel from sliding back out from the front panel.

Thus, the front and rear panels may be initially secured together for providing a sealed package containing a valuable product, and may be easily separated and opened for close manual viewing and inspection, and later resealed, all without damage to the package as regards either structure, function or appearance.

Figure 1:
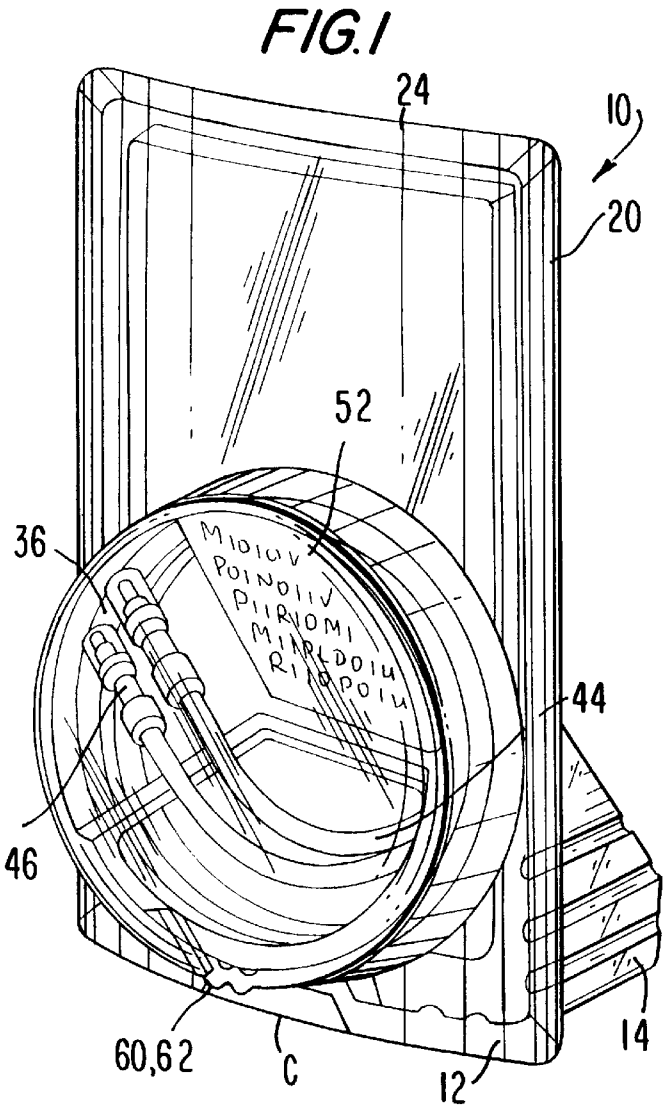
FIG. 1 is a front perspective view of the new package design.
Figure 3:
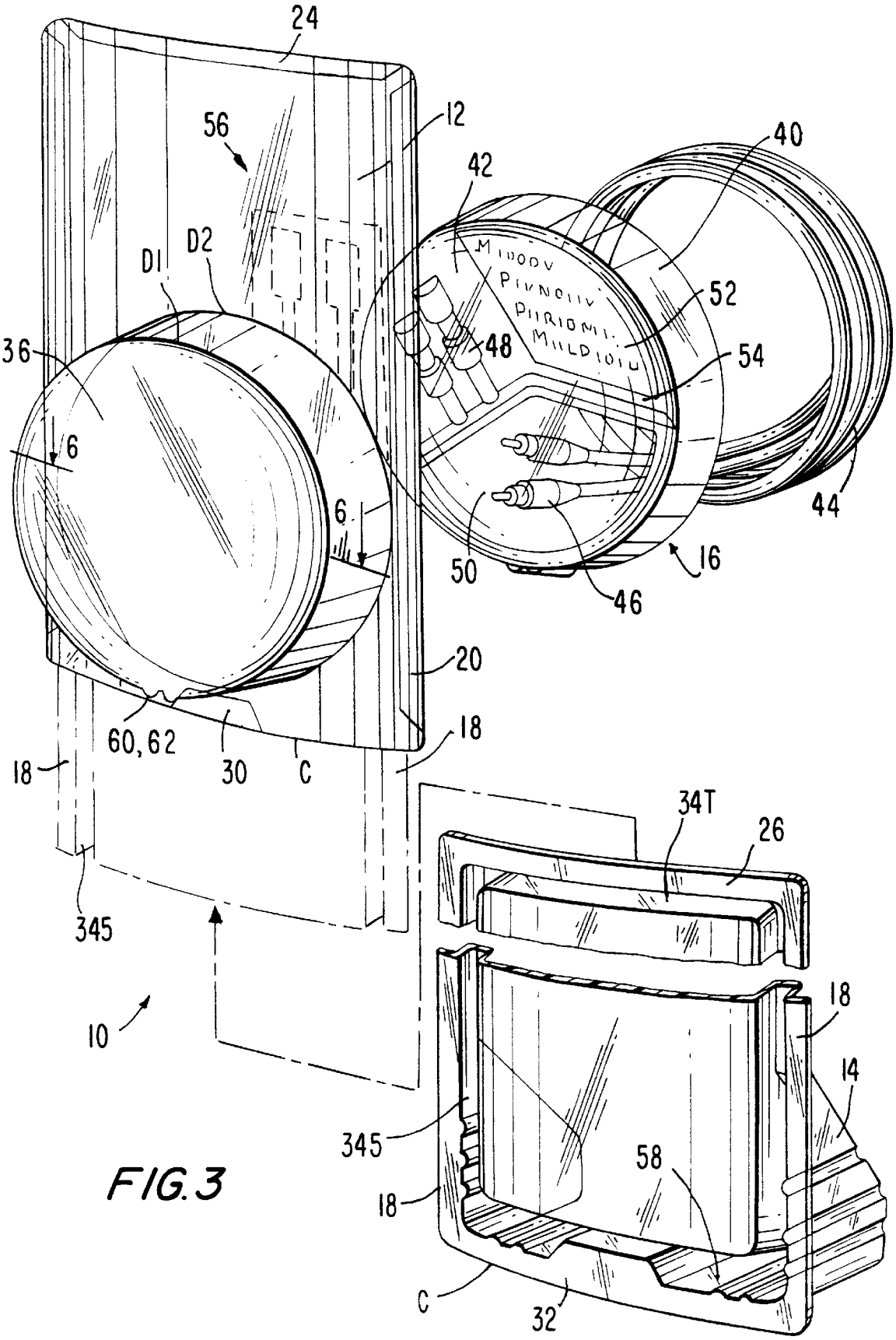
FIG. 3 is an exploded perspective view showing the front and rear panels and insert.
Figure 4:
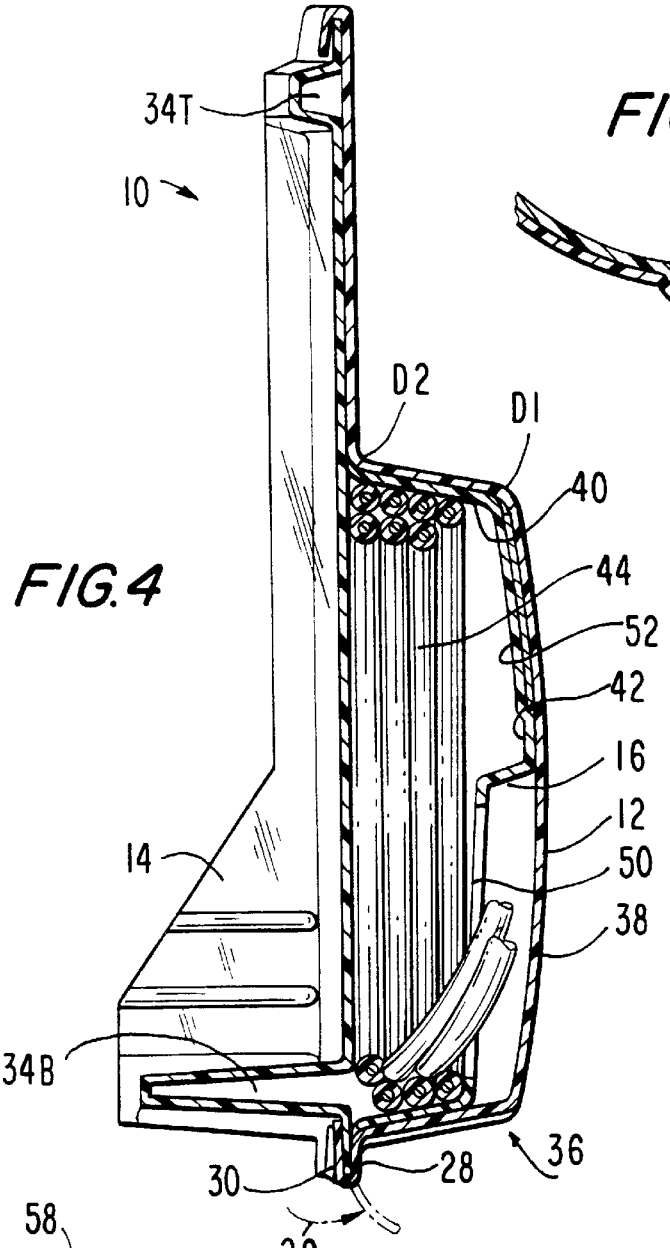
FIG. 4 is a cross-sectional view taken along line 4—4 in FIG. 2.
Figure 5:
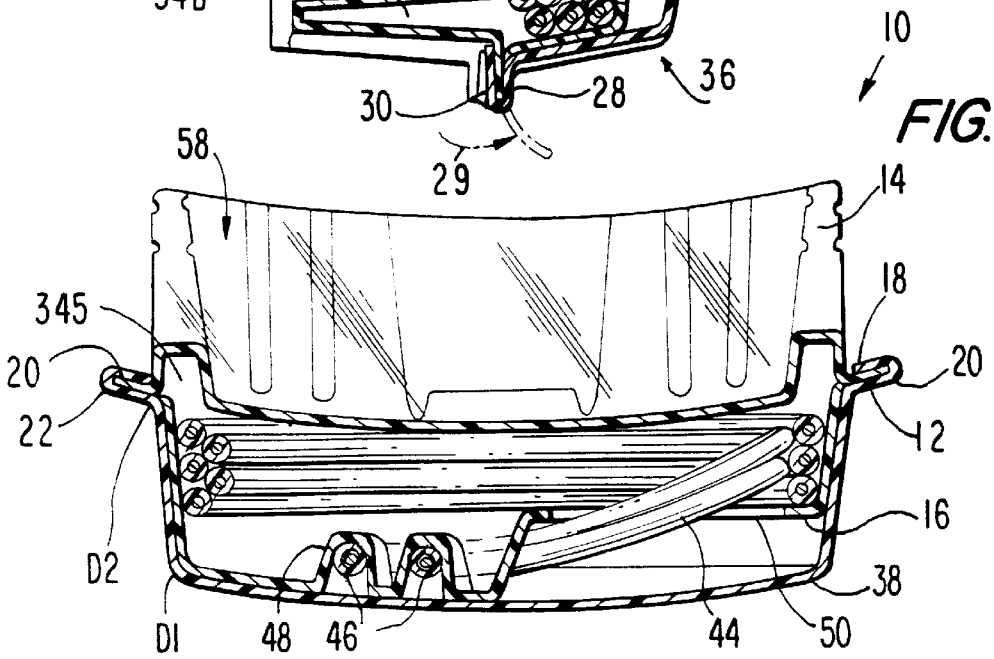
FIG. 5 is a cross-sectional view taken along line 5—5 in FIG. 2.

Both front and rear panels are essentially straight in the longitudinal dimension from top to bottom as seen in FIGS. 1–4; however, these panels in the transverse dimension are curved as seen in FIGS. 1, 3 and 5 by curved lines C.

For additional strength rear panel 14 has a trough forming a rib in the opposite direction along its periphery where the rib walls provide strength of a channel or U-shape beam. This rib extends on panel 14 as 34S along the sides, 34T at the top edge and 34B at the bottom. The depth of the walls of ribs 34S and 34T is the same, however, the depth of the walls of rib 34B is far greater and thus provides substantially more strength.

Figure 6:
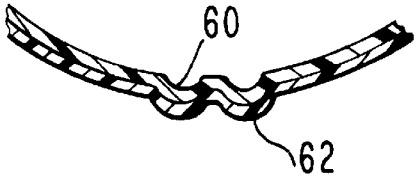
FIG. 6 is a fragmentary sectional view taken along line 6—6 in FIG. 3.

In front panel 12 is a forwardly extending cylindrical projection or dome 36 whose walls are slightly tapered to terminate in a dome top of smaller diameter D1 than the diameter of D2 the open base, as seen in FIGS. 1 and 4. Most significantly, the dome top has a curved generally spherical surface 38 as seen in FIGS. 5 and 6. In this preferred embodiment the curvature of dome 38 corresponds generally to the curvature C of the front and rear panels, and this dome has diameter close to the width of the whole package.

The dome's curved surface greatly reduces glare from ceiling and other interior lights in stores where these packages are displayed, and also allow more light to enter and better illuminate the contained product.

The insert or third component 16 for the assembled package has tapered walls 40 and a top dome surface 42 similar to corresponding parts of the dome 36 in the front panels, and dimensioned so that the insert's dome is easily inserted into the front panel's dome.

The insert is provided to contain, hold and display one or more coiled speaker cables or other connector cables 44, and to do so in a highly visible and dramatic presentation. The coiled cable fits neatly within the cavity of the dome of the insert as seen in FIGS. 3–5. To show off the usually gold-plated connectors 46 at ends of the cables the insert has finger-like pockets or recesses 48 to receive and neatly hold and display individual connectors. The insert 16 includes an open window 48 for the ends of the cable to extend outward from the coil 44 and into the finger recesses 48. These recesses extend rearward of the insert's dome 42 which is oppositely of the frontward extension of the dome of the insert and of the front panel.

Another feature of insert 16 is a defined area 52 on a part of the insert's dome surface 42 for receiving an adhesive label. Preferably this area 52 is slightly recessed from the dome surface 42 to define a border to enhance the label. More significantly, the position of a label on the insert dome beneath the front panel dome provides a novel and most appealing "label under glass" appearance that might be associated with traditionally high quality and high priced products that are literally under glass.

The combination of the front panel and insert domes and special connector display finger recesses and "label-under-glass" features produce a package of new visibility and attractiveness. As discussed earlier, the insert concept allows one to display a great variety of products with the same basic front and rear panel package, while merely varying the inserts. For example, one could have three, four or more finger-recesses in the insert's dome. Also, and optionally, one could extend transversely the insert dome and the front panel dome as seen in dotted line 56 in FIGS. 2 and 3 to display additional or opposite end connectors.

The front and rear panels and insert are made from thin transparent plastic sheet, each being a contiguous component formed to include the features described, and made from a common plastic such as polypropylene, polyacrylate and polyethylene.

A further feature of the package seen in FIGS. 3 and 5 is the space 58 established between the side troughs or ribs 34S and top rib 34T which corresponds generally to the diameter D2 of the front panel dome. The dome of one package can fit generally within the space 58 of an adjacent and similarly oriented next package. The deep ribs 34B also form a ledge or leg extending transversely to suggest this package in a generally standing mode.

An additional feature is key 60 on the edge of the dome of the insert that engage mating keyway 62 on the edge of the dome of the front panel. This is seen in FIGS. 1–4 and 6. This key assures that the insert and the product it holds and displays are properly oriented in the front panel.

The package and features described herein may vary within the scope and spirit of this invention, as defined in the claims appended hereto.

We claim:

1. A display package for containing a product for sale, the package providing high visibility of the product and relatively easy accessibility for manual inspection of the product, comprising:

a. a transparent plastic sheet front part with a central portion and with opposite side edges formed as side tracks and top and bottom edges, b. a transparent plastic sheet back part with a central portion and with opposite side edges formed as flanges which are adapted to slide in corresponding tracks of said front part for releasably joining said front and back parts so that their respective central portions are overlying, said back part also having top and bottom edges, said top and bottom edges respectively of said front and back parts also being releasably engageable when said front part is slid into overlying relationship with said back part, said front part further comprising a generally cylindrical frontward extending projection situated between said side, top and bottom edges, said projection in the frontward axial direction thereof being tapered to a smaller size and terminating in a convex dome also extending in said frontward directions, said projection defining a first cavity therein, and c. a transparent plastic sheet insert comprising a tapered generally cylindrical projection terminating as a convex dome corresponding to and adapted to fit into said domed projection in said front part, said projection of said insert defining a primary cavity therein, said insert including a plurality of secondary cavities extending rearward in the surface of its dome for receiving and holding parts of the product, said insert when the product is situated in said primary and secondary cavities adapted to be positioned in the first cavity of said front part while said front and back parts are releasably joined.

2. A display package according to claim 1 wherein said side tracks on said front part comprise said side edges of said front part folded approximately 180°.

3. A display package according to claim 2 wherein said top edge of said front part is folded approximately 180° forming a top track into which the top edge of said back part is slidable.

4. A display package according to claim 1 wherein said back part is curved convexly frontward about a vertical axis.

5. A display package according to claim 1 or 4 wherein said back part further comprises side, top and bottom stiffening ribs respectively situated inwardly of its side edges and top and bottom edges.

6. A display package according to claim 5 wherein said stiffening ribs are projections extending rearwardly of the central portion of said back part.

7. A display package according to claim 6 wherein said top and side stiffening ribs extend rearwardly the same distance, and said bottom stiffening rib extends rearwardly a substantially greater distance than said top and side stiffening ribs.

8. A display package according to claim 6 wherein said front and back parts and insert are each a single contiguous sheet.

9. A display package according to claim 8 wherein said front and back parts and insert are all formed of plastic selected from the group comprising polypropylene, polyacrylate and polyethylene.

10. A display package according to claim 5 wherein each of said side stiffening ribs is situated immediately adjacent one of said side edges that slide in the tracks of said front part.

11. A display package according to claim 5 wherein the inner dimension between said side stiffening ribs corresponds generally to the outer dimension of the dome projections, thus facilitating nesting of one package dome into the space between side ribs of another package.

12. A display package according to claim 1 wherein the insert further comprises a defined label placement area on the outer surface of its dome for receiving thereon an adhesive-backed label, thereby providing a sandwich construction label between the outer dome of front part and the inner dome of the insert.

13. A display package according to claim 1 wherein the convex curve of the domes of said front part and of said insert is generally spherical.

14. A display package according to claim 1 wherein the insert defines in its dome surface an array of closely adjacent secondary recesses formed as fingers for receiving and holding in each secondary recess one connector terminating one end of a cable in the package.

15. A display package according to claim 1 wherein at least one wall of said projection extending axially forward in said front part has an additional projection extending transversely forming an additional cavity communicating with said first cavity, said insert having an additional projection extending transversely similar to that of said front part for receiving and displaying parts of said product, said insert with its projection and additional projection adapted to fit within said projection and additional projection of said first part.

16. A display package according to claim 1 wherein said additional projections of said front part and said insert are tapered to become smaller in the frontward direction.

17. A display package according to claim 16 wherein said additional projections extend transversely from said domes upwardly toward said top edges of said front part and insert respectively.

18. A display package according to claim 16 wherein said additional projection extends in the frontward direction a lesser distance than said domed projection.

19. A display package for containing a product for sale, comprising:

a front part comprising a transparent plastic sheet defining a first plane, said front part having a central portion and with opposite side edges and top and bottom edges, and a back part comprising a transparent plastic sheet with a central portion and with opposite side edges which are adapted to slidably engage said side edges of said front part for releasably joining said front and back parts so that their respective central portions are overlying, said back part also having top and bottom edges, said top and bottom edges respectively of said front and back parts also being releasably engageable when said front part is slid into overlying relationship with said back part, said front part further comprising a generally cylindrical frontward extending projection situated between said side, top and bottom edges, said projection in the frontward axial direction thereof having a base at said first plane and being tapered from said first plane in the frontward direction to a smaller size and terminating in a convex curved dome also extending in said frontward direction, said projection defining a first cavity therein.

20. A display package for containing a product for sale comprising:

a. a transparent plastic sheet front part with a central portion and with opposite side edges and top and bottom edges, b. a transparent plastic sheet back part with a central portion and with opposite side edges which are adapted to slidably engage said side edges of said front part for releasably joining said front and back parts so that their respective central portions are overlying, said back part also having top and bottom edges, said top and bottom edges respectively of said front and back parts also being releasably engageable when said front part is slid into overlying relationship with said back part, said front part further comprising a generally cylindrical frontward extending projection situated between said side, top and bottom edges, said projection in the frontward axial direction thereof being tapered to a smaller size and terminating in a convex dome also extending in said frontward direction, said projection defining a first cavity therein, and c. a transparent plastic sheet insert comprising a tapered cylinder having one end open and the opposite end terminating as a convex dome corresponding to and adapted to fit into said domed projection in said front part, said insert defining a primary cavity therein, said insert including a plurality of secondary cavities extending rearward in the surface of its dome for receiving and holding parts of the product, said insert when the product is situated in said primary and secondary cavities adapted to be positioned in the first cavity of said front part.

* * * * *